US006071169A

United States Patent [19]

Cook

[11] Patent Number: 6,071,169

[45] Date of Patent: Jun. 6, 2000

[54] DOLL HAVING HICCUPPING FEATURE

[75] Inventor: Robynn M. Cook, Aliso Viejo, Calif.

[73] Assignee: Mattel, Inc., El Segundo

[21] Appl. No.: 09/245,987

[22] Filed: Feb. 5, 1999

[51] Int. Cl.[7] ..... A63H 3/00; A63H 3/28

[52] U.S. Cl. ..... 446/300; 446/338; 446/330; 446/295

[58] Field of Search ..... 446/295, 297, 446/298, 299, 300, 330, 337, 338, 391

[56] References Cited

U.S. PATENT DOCUMENTS

| | | |
|---|---|---|
| 2,653,411 | 9/1953 | Beltz . |
| 3,416,488 | 12/1968 | Merl . |
| 3,419,994 | 1/1969 | Glass et al. . |
| 3,755,960 | 9/1973 | Tepper et al. . |
| 3,956,850 | 5/1976 | Seidenberg . |
| 3,996,695 | 12/1976 | Sapkus et al. . |
| 4,003,157 | 1/1977 | Guerrero . |
| 4,160,338 | 7/1979 | Lyons et al. . |
| 4,249,338 | 2/1981 | Wexler . |
| 4,263,742 | 4/1981 | Terzian . |
| 4,356,663 | 11/1982 | Terzian . |
| 4,734,074 | 3/1988 | Kinberg et al. . |
| 4,917,645 | 4/1990 | Amici et al. . |
| 5,083,965 | 1/1992 | Mayem . |
| 5,094,644 | 3/1992 | Kelley . |
| 5,944,533 | 8/1999 | Wood ..... 434/322 |

*Primary Examiner*—Robert A. Hafer
*Assistant Examiner*—Laura Fossum
*Attorney, Agent, or Firm*—Roy A. Ekstrand

[57] ABSTRACT

A doll includes a sound and movement unit within the torso thereof operative to simultaneously raise and lower the doll's head to mimic a hiccupping motion. A sound circuit within the sound and movement unit is operative to provide accompanying hiccup sounds. The movement and sound unit includes an inertia switch and a mouth switch both of which cooperate to allow the user to attempt appropriate action to terminate the doll's hiccupping.

1 Claim, 2 Drawing Sheets

10
11
12
13
14
15
16
17
18
21
22
23
24
25
26
30
31
40
41
42
43

DOLL HAVING HICCUPPING FEATURE

FIELD OF THE INVENTION

This invention relates generally to dolls and particularly to those having features which mimic the patterns of behavior by young children and infants.

BACKGROUND OF THE INVENTION

Toy dolls which generally resemble human infants have proven to be a long term, high popularity category of dolls which shows no signs of diminishing in future years. Such dolls are often provided with various activity features, many of which tend to generally mimic human infant behavior. Accordingly, dolls have been provided which simulate activities such as eating, drinking, crying, crawling, walking, diaper wetting and sneezing.

For example, U.S. Pat. No. 4,003,157 issued to Guerrero sets forth a SNEEZING DOLL IMPROVEMENT having a pressurizable bellows in the doll's head whereupon the bellows is relieved such that the doll's head will move forwardly under the influence of a spring while air from the bellows is simultaneously directed to a reservoir forcing water out of the doll's nose.

U.S. Pat. No. 3,996,695 issued to Sapkus, et al. sets forth a SNEEZING DOLL having a bellows mechanism supported within a doll's head for forward movement under the influence of a spring. The air bellows is simultaneously directed to a liquid reservoir forcing a quantity of liquid out through the doll's nose.

U.S. Pat. No. 3,419,994 issued to Glass, et al. sets forth a SNEEZING DOLL having a torso supporting at least one movable arm and a mechanism including a bellows therein which operates to expel a sneezing sound while moving the pivotal arm upwardly toward the doll's mouth.

U.S. Pat. No. 3,416,488 issued to Merel sets forth a SOUND PRODUCING DEVICE having a collapsible bladder with an internal spring urging the bladder toward extension both of which being supported within a doll torso. A sound making reed within the bellows responds to collapse thereof to expel a sound.

U.S. Pat. No. 4,917,645 issued to Amici, et al. sets forth a DOLL WITH SOUND GENERATING MECHANISM having a cavity defining an enclosure within the doll's head and a sound generating bladder within the enclosure. A compressible pillow in the doll torso includes a conduit extending to the bladder. When the pillow is compressed, air passing through the bladder causes it to produce a sound.

U.S. Pat. No. 2,653,411 issued to Beltz sets forth a DRINKING AND WETTING DOLL WITH SOUND EFFECTS having a doll torso supporting a liquid reservoir and a hollow tube extending upwardly to the doll's mouth. Means are provided for triggering a wetting cycle in response to pressure at the doll's mouth.

U.S. Pat. No. 4,160,338 issued to Lyons, et al. sets forth a SOUND EMITTING AND WETTING DOLL having a first bellows supported within a doll torso and a second bellows supported within the doll head. A mouth aperture is coupled to the bellows arrangement by a hollow tube. A liquid reservoir is responsive to the head bellows and is coupled to a hollow tube extending downwardly to an exit orifice at the lower torso.

U.S. Pat. No. 3,956,850 issued to Seidenberg sets forth a KISSING DOLL HAVING SQUEEZEABLE ARM AND SOUNDER LOCATED SUBSTANTIALLY MIDWAY BETWEEN ARM AND MOUTH in which a doll utilizes an air-driven sound device within a throat tube to create the desired sounds.

U.S. Pat. No. 4,249,338 issued to Wexler sets forth a DOLL WITH SOUND GENERATOR AND PLURAL SWITCH MEANS having an electronic sound producing circuit which responds to switch input to retrieve a predetermined sound signal from memory and play it through an audio device.

U.S. Pat. No. 4,263,742 issued to Terzian sets forth an ANIMATED DOLL having a hollow head and body together with a face and a mouth opening. A pair of lips define oppositely longitudinal edges of the mouth and a movable tongue extends outwardly through the lips as the doll is manipulated.

U.S. Pat. No. 4,356,663 issued to Terzian sets forth a CRYING DOLL having a doll torso supporting a liquid reservoir and a head pivotally secured to the torso. A pump mechanism is operative in the doll to move a quantity of liquid upwardly into the reservoir. A conduit is provided between the reservoir and regions of the doll's eyes to simulate crying.

U.S. Pat. No. 4,734,074 issued to Kinberg, et al. sets forth an ANIMATED NOVELTY DEVICE shaped in the form of an animated creature and having a flexible body portion. The eyes include a light source connected to be operatively associated with a sound device located within the body.

U.S. Pat. No. 5,083,965 issued to Mayem sets forth an INTERACTIVE DOLL SYSTEM which incorporates both liquid handling elements for receiving liquid through the mouth and then dispensing that liquid through the eyes of the doll as a function of doll position. A secondary tube couples liquid to an orifice on the bottom of the doll's torso.

U.S. Pat. No. 5,094,644 issued to Kelley sets forth a DOLL HAVING DELAYED WETTING AND CRYING ACTION.

While the foregoing described doll products have improved the art and in some instances enjoyed commercial success, there remains nonetheless a continuing need in the art for evermore improved, amusing and entertaining doll products.

SUMMARY OF THE INVENTION

Accordingly, it is a general object of the present invention to provide an improved doll. It is a more particular object of the present invention to provide an improved doll having a feature which mimics the hiccupping action of a young infant.

In accordance with the present invention, there is provided a doll comprising: a dolly body having a head, a pair of arms and hands, a pair of legs, a torso and a neck; a sound and movement unit supported within the torso having a movable neck support coupled to the head, the sound and movement unit operative to raise and lower the head upon the neck support; a sound circuit supported within the sound and movement unit for audiblizing a hiccupping sound; a start switch coupled to the sound and movement unit for energizing the sound and movement unit and the sound circuit to mimic hiccup sound and movement; and an end switch located on the body coupled to the sound and movement unit to terminate the hiccup sound and motion.

BRIEF DESCRIPTION OF THE DRAWINGS

The features of the present invention, which are believed to be novel, are set forth with particularity in the appended claims. The invention, together with further objects and advantages thereof, may best be understood by reference to the following description taken in conjunction with the accompanying drawings, in the several figures of which like reference numerals identify like elements and in which:

DESCRIPTION OF THE PREFERRED EMBODIMENT

Figures 1, 2:
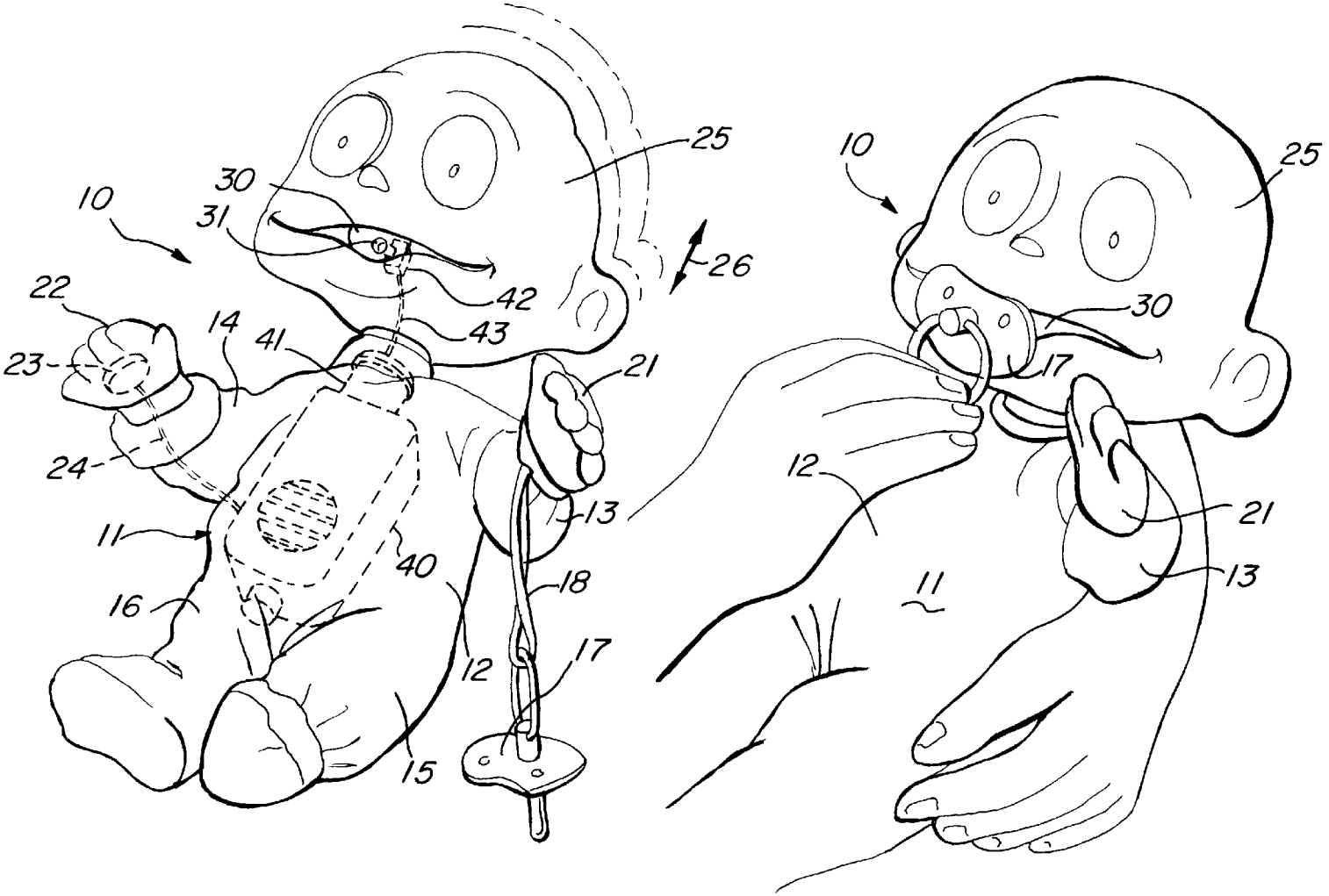
FIG. 1 sets forth a front perspective view of a doll constructed in accordance with the present invention.
FIG. 2 sets forth a partial front perspective view of the present invention doll having a pacifier received therein.

FIG. 1 sets forth a front perspective view of a doll constructed in accordance with the present invention and generally referenced by numeral 10. Doll 10 includes a body 11 preferably formed of a soft plush material and having a torso 12, a pair of arms 13 and 14 supporting hands 21 and 22. Torso 12 further supports legs 15 and 16. A head 25 is supported upon a neck support 41 and includes a mouth 30 having an aperture 31 formed therein. A socket switch 42 is supported within head 25 by conventional means (not shown). Socket 42 is operatively coupled to a connecting wire set 43.

In further accordance with the present invention, a movement and sound unit 40 is supported within torso 12 and is operatively coupled to socket 42 by connecting wires 43. A pressure sensitive start switch 23 is supported within hand 22 and coupled to unit 40 by a plurality of connecting wires 24. A pacifier 17 is supported by a tether 18 secured to arm 13 of doll 10.

In operation and by means set forth below in greater detail, the user presses start switch 23 causing unit 40 to begin producing a hiccupping sound and to begin raising and lowering neck support 41 to move head 25 in the direction indicated by arrow 26. The hiccupping will continue as the user endeavors to undertake activities which will cause doll 10 to cease its hiccupping. Thus, for example, the insertion of pacifier 17 through aperture 31 of mouth opens the switch within socket 42 terminating the hiccupping action and sound. Alternatively, an inertia switch 50 (seen in FIG. 3) responds to certain other movements such as patting the doll's back or lulling the doll to sleep in a cradle-like position.

FIG. 2 sets forth a partial perspective front view of doll 10 being held in a cradled position. Doll 10 includes a head 25, a body 11 having a torso 12 and an arm 13 supporting a hand 21. Head 25 defines a mouth portion 30 which receives a pacifier 17. In the configuration shown in FIG. 2, the user has quieted doll 10 and terminated the hiccupping sound and action by the insertion of pacifier 17 into mouth aperture 31 (seen in FIG. 1).

Figure 3:
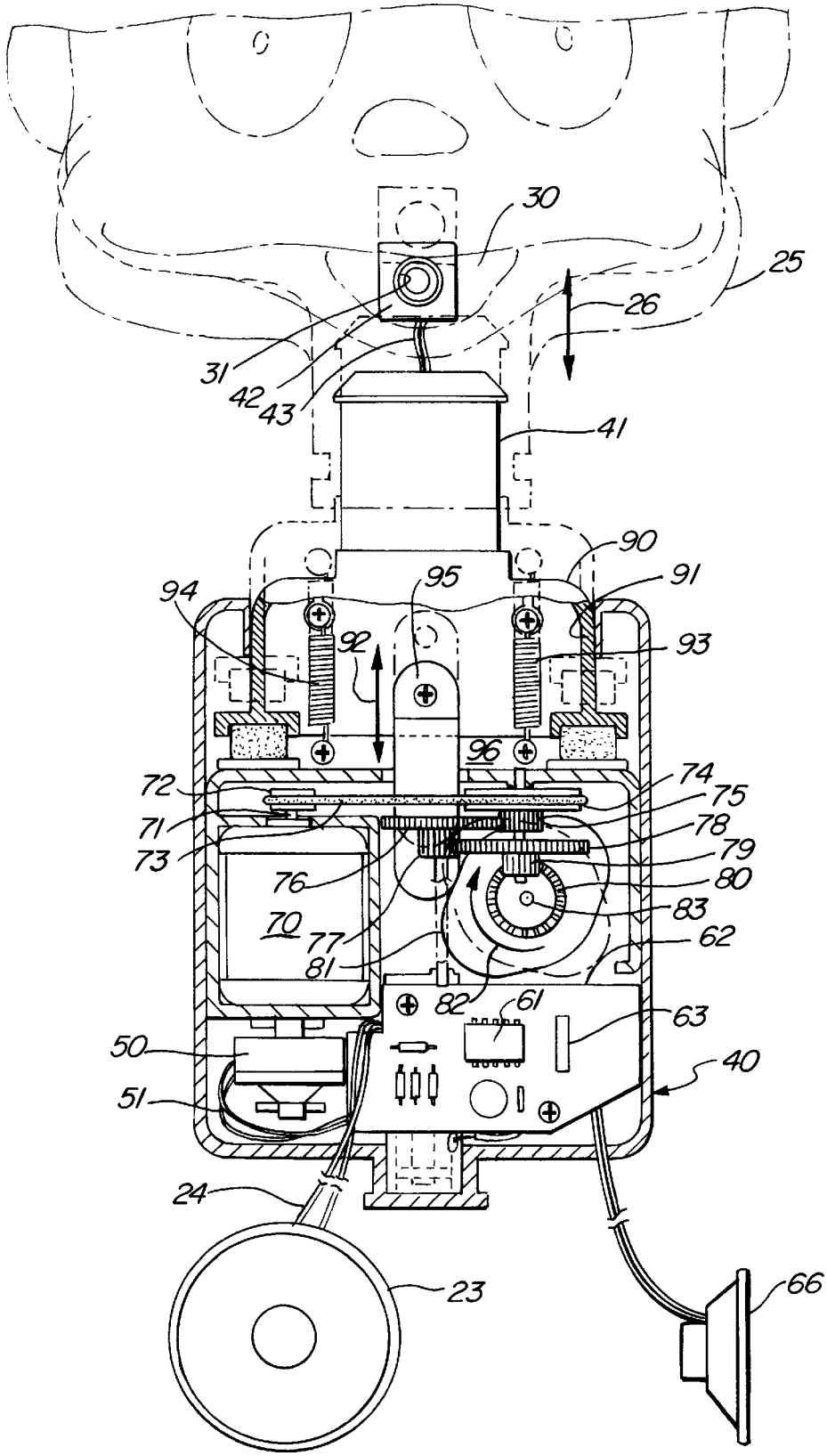
FIG. 3 sets forth a partial section view of the operative mechanism within the present invention doll.

FIG. 3 sets forth a partially sectioned front view of the action feature mechanism of the present invention doll. A movement and sound unit 40 defines an internal channel 91 within which a slide housing 90 is supported. A pair of springs 93 and 94 couple slide housing 90 to a fixed bar 96 to provide a spring force urging slide housing 90 toward bar 96 forming the contracted position of slide housing 90 shown in solid-line representation.

Unit 40 further includes a sound circuit 60 having a printed circuit board 62 supporting a plurality of electronic components 63 together with an integrated circuit sound device 61.

Sound circuit 60 is fabricated in accordance with conventional fabrication techniques and utilizes an internal memory having stored audio data and a microprocessor having a stored instruction set to provide sound signal output. As is well understood by those skilled in the art, a variety of standard speech or sound circuits may be utilized in place of sound circuit 60. The essential characteristics of sound circuit 60 is the provision of appropriate signals to speaker 66 for audiblizing a predetermined speech message or sound combination each time switch 23 is activated. For example, a combination of a microprocessor, read only memory, speech synthesizer and audio output amplifier suitable for the functioning of circuit 60 is formed as a single integrated circuit chip device manufactured by Texas Instruments, Inc. under the device name TMS50C44. However, it will be understood that a variety of standard integrated circuit devices may be used for circuit 60.

A movement mechanism within unit 40 includes a motor 70 operatively coupled to one or more batteries (not shown). Motor 70 includes an output shaft 71 supporting a pulley 72. A pulley 74 is rotatably supported within unit 40 and includes a gear 75 joined thereto. A flexible belt 73 couples pulley 72 to pulley 74. Gear 75 engages a gear 76 having a smaller gear 77 which in turn engages a gear 78. It will be noted that gear 78 is supported upon a common shaft with gear 75 but is freely movable with respect to gear 75. Gear 78 further includes a smaller diameter gear 79.

A cam 81 is rotatably supported upon a shaft 83. Cam 81 is rotated by the engagement of gear 79 with gear 80 upon shaft 83 in the direction indicated by arrow 82.

A cam follower 95 is secured to slide housing 90 at its upper end and extends downwardly against cam 81. Thus, as cam 81 rotates, the high portions or lobes of cam 81 force follower 95 upwardly against the force of springs 93 and 94 raising the head portion of doll 10 in the above-described hiccupping motion shown in FIG. 1. Each time the low portion of cam 81 contacts follower 95, the force of springs 93 and 94 returns cam follower 95 and slide housing 90 to the lowered position.

Unit 40 further includes an inertia switch 50 operatively coupled to sound circuit 60 together with a start switch 23 coupled to circuit 60 by connecting wires 24. A pair of connecting wires 51 couple inertia switch 50 to circuit 60.

In operation, unit 40 initially rests in the compacted position shown in solid-line representation. When the user actuates start switch 23, motor 70 is energized rotating pulleys 71 and 74. The rotation of pulley 74 communicates rotating power to gear 79 through gears 76, 77 and 78. Gear 79 engages cam gear 80 causing cam 81 to rotate in the direction by arrow 82. This rotation drives cam follower 95 and slide housing 90 to the raised position shown in dashed-line after which cam 81 continues rotation allowing springs 93 and 94 to restore slide housing 90 to its lowered position. As cam 81 rotates rapidly, the up and down motion of head 25 resulting mimics the action of a child hiccupping.

The activation of unit 40 achieved by pressing start switch 23 also causes sound circuit 60 to output a hiccup-like sound. This process continues on a repeated basis until the user manages to stop it. The user may stop the hiccupping action by either manipulating the doll and petting it or the like which activates inertia switch 50 to deactivate motor 70 through circuit 60 or, alternatively, the user may insert pacifier 17 (seen in FIG. 1) into mouth aperture 31 and switch 42 to again disable motor 70.

What has been shown is a doll having a hiccupping feature in which a realistic head motion is imparted to the doll which closely mimics the hiccupping sound produced by the sound circuit therein.

While particular embodiments of the invention have been shown and described, it will be obvious to those skilled in the art that changes and modifications may be made without departing from the invention in its broader aspects. Therefore, the aim in the appended claims is to cover all such changes and modifications as fall within the true spirit and scope of the invention.

That which is claimed is:

1. A doll comprising:

a dolly body having a head, a pair of arms and hands, a pair of legs, a torso and a neck;

a sound and movement unit supported within said torso having a movable neck support coupled to said head, said sound and movement unit operative to raise and lower said head upon said neck support;

a sound circuit supported within said sound and movement unit for audiblizing a hiccupping sound;

a start switch coupled to said sound and movement unit for energizing said sound and movement unit and said sound circuit to mimic hiccup sound and movement; and an end switch located on said body coupled to said sound and movement unit to terminate said hiccup sound and motion.

* * * * *